US006481137B2

(12) United States Patent
Kornberger

(10) Patent No.: US 6,481,137 B2
(45) Date of Patent: Nov. 19, 2002

(54) REVOLVING FIREARM

(76) Inventor: Johann Franz Kornberger, 427 Hamill Rd., Indiana, PA (US) 15701

( * ) Notice: Subject to any disclaimer, the term of this patent is extended or adjusted under 35 U.S.C. 154(b) by 0 days.

(21) Appl. No.: 09/824,398

(22) Filed: Apr. 2, 2001

(65) Prior Publication Data

US 2002/0078614 A1 Jun. 27, 2002

Related U.S. Application Data

(60) Provisional application No. 60/257,615, filed on Dec. 26, 2000, and provisional application No. 60/274,149, filed on Mar. 9, 2001.

(51) Int. Cl.[7] ..... F41C 3/14

(52) U.S. Cl. ..... 42/59; 42/67; 42/39.5; 42/60

(58) Field of Search ..... 42/60, 59, 19, 42/67, 39.5; 89/13.05, 155, 33.03, 13

(56) References Cited

U.S. PATENT DOCUMENTS 618,369 A * 1/1899 Wilson ..... 42/49.01
2,798,329 A * 7/1957 Radatz ..... 124/48
2,835,171 A * 5/1958 Lyon ..... 42/59
2,930,041 A * 3/1960 Massacrier ..... 227/11
3,145,495 A * 8/1964 Katz et al. ..... 42/19
3,369,314 A * 2/1968 Ramsay ..... 42/39.5
4,156,981 A * 6/1979 Lusk ..... 42/105
4,547,988 A * 10/1985 Nilsson ..... 42/16
4,856,410 A * 8/1989 Anderson ..... 89/155
4,897,949 A * 2/1990 Whiteing ..... 42/10
5,027,542 A * 7/1991 Simonetti ..... 42/72
5,119,575 A * 6/1992 Gajdica ..... 42/19
5,561,258 A * 10/1996 Bentley et al. ..... 42/49.01

* cited by examiner

*Primary Examiner*—Michael J. Carone
*Assistant Examiner*—Denise J Buckley
(74) *Attorney, Agent, or Firm*—Klaus J. Bach

(57) ABSTRACT

In a revolving firearm having a barrel and a rotating cartridge cylinder actuated by an axially slidable pump-action type foregrip, indexing means are provided for converting the back and forth movement of the foregrip into a stepwise rotational movement of the cartridge cylinder for bringing one chamber of the cartridge cylinder after another in axial alignment with the barrel.

12 Claims, 5 Drawing Sheets

REVOLVING FIREARM

This Application claims benefit of Provisional Application Ser. No. 60/257,615 filed Dec. 26, 2000, and claims benefit of Ser. No. 60/274,149 filed Mar. 9, 2001.

BACKGROUND OF THE INVENTION

The present invention relates to revolving firearms and particularly resides in an indexing mechanism for the stepwise rotation of the cartridge cylinder of a revolving firearm.

Present methods for the rotation of the cylinders of revolving firearms include a trigger activated mechanism, which is however suitable only for small caliber firearms. Also spring-motor-driven cylinders are known. They have the disadvantage that the spring motor needs to be wound up from time to time so that the firearm is not always ready for operation.

SUMMARY OF THE INVENTION

In a revolving firearm having a barrel and a rotating cartridge cylinder actuated by an axially slidable pump-action type foregrip, indexing means are provided for converting the back and forth movement of the foregrip into a stepwise rotational movement of the cartridge cylinder for bringing one chamber of the cartridge cylinder after another in axial alignment with the barrel. This unique mechanism allows the user to rotate the cartridge cylinder in a manner similar to conventional pump action shotguns.

The present invention is an improvement over existing arrangements; it is especially intended for use in connection with large-caliber firearms, i.e. −12 GA up to 40 mm. It can however also be used in smaller caliber firearms, especially for providing a unique pump action revolving firearm.

The invention will be described below in greater detail with reference to a particular embodiment of the invention which is schematically represented in the accompanying drawings.

DESCRIPTION OF PREFERRED EMBODIMENTS

The firearm consists of a front frame part 1*a* and a rear frame part 1*b* which can be locked together by a latching mechanism 9. A cylinder 2 having chambers for holding cartridges is rotatably supported on the front frame part 1*a*.

The cylinder 2 can be designed for various calibers of cartridges or rounds of ammunition and for receiving various numbers of cartridges or rounds. A barrel 3 is supported on the front frame part 1*a* and a trigger mechanism, which is not shown in detail, is disposed in the rear frame part 1*b*. A stock 5 is also fitted to the rear frame part 1*b*.

The firearm includes an indexing mechanism for rotating the cylinder in a simple and safe manner from one chamber to the next. The design is such that the cartridge chambers of the cylinder 2 are aligned with the barrel 3 and while a cartridge chamber is aligned with the barrel, the cylinder 2 is securely held in such an aligned position for the firing of a cartridge.

Figure 1:
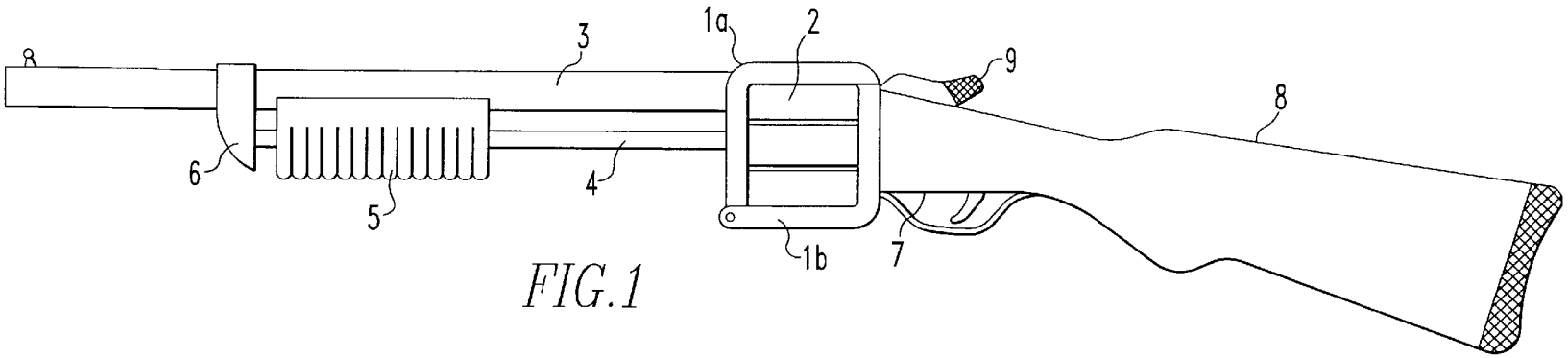
FIG. 1 is a side view of the firearm with a cartridge cylinder according to the invention.
Figure 2A:
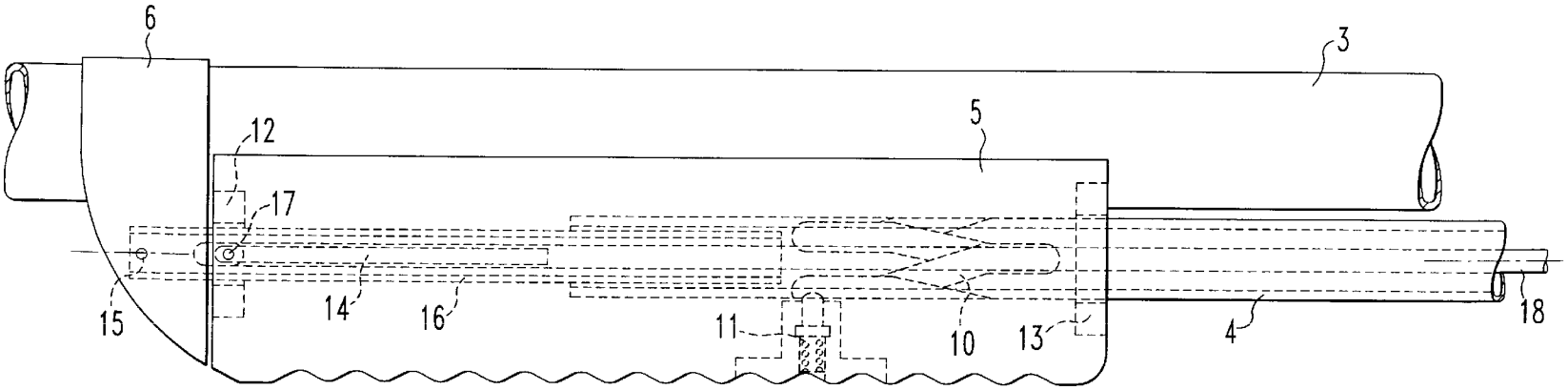
FIG. 2A shows specifically an indexing mechanism for rotating the cartridge cylinder of the firearm with a pump action motion.
Figure 2B:
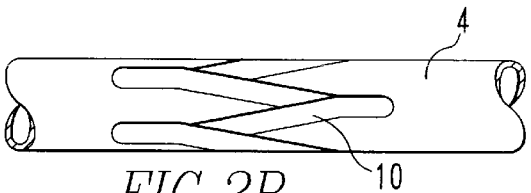
FIG. 2B shows a part of the indexing mechanism which includes a tube with grooves provided for the rotation of the rotating cylinder, and FIG. 2C another embodiment for the indexing mechanism.

The indexing mechanism consists of a rotating tube 4, which is fixed to the cylinder 2 for rotation therewith and includes an arrangement of grooves 10. The grooves 10 are machined into the surface of the rotatable tube 4 at an angle with respect to the longitudinal axis of the tube 4. Circumferentially adjacent grooves 10 extend at opposite angles and are joined at their longitudinal ends and form pairs. The grooves extend together in a zick-zack pattern around the rotatable tube 4 as shown in FIG. 2B. The number of pairs of grooves 10 corresponds to the number of cartridge openings in the cylinder 2. The grooves are also somewhat inclined with respect to the axis of the rotatable tube 4 such that the end of one groove is at a radially somewhat higher level than the beginning of the next. In this way the spring-loaded pin drops into the next groove when the end of one groove is reached by axial movement of the foregrip 5.

A foregrip 5 is supported below the barrel 3 so as to be slidable along the barrel 3. The foregrip 5 includes a bore through which the rotatable tube 4 extends into foregrip 5. The foregrip 5 is axially movable and is engaged by the barrel 3 to prevent its rotation. A spring-loaded actuating pin 11 is fitted into the foregrip 5 and extends into the angled grooves 10. A front bracket 6 is mounted to the barrel 3 and supports a front tube 16, which extends into the foregrip 5. The front tube 16 has one end mounted to the front bracket 6 by a pin 15. The other end of the front tube 16 is received in the rotatable tube 4 for rotatably engaging the rotatable tube 4.

A cocking rod 18 extends through the rotatable tube 4 and into the front tube 16 and is fixed, by way of a pin 17, to a slide bearing member 12 which is mounted to the foregrip 5 and slidably supported on the front tube 16. The front tube 16 has a slot 14, through which the pin 17 extends and is connected to the cocking rod 18 for moving the cocking rod 18 back and forth together with the foregrip 5.

To rotate the cylinder from one cartridge chamber to the next, the operator has to push or pump the foregrip 5 back and forth one time. This "pumping" is similar to the operation of conventional pump action shotguns.

Upon pulling or pumping the foregrip back, the spring-loaded pin 11 sliding in the groove 10 causes the rotatable tube 4 to rotate halfway to the next alignment position. Pushing the foregrip then again forward completes the rotation step and brings the next cylinder chamber in alignment with the barrel 3. While moving the forgrip back the cocking rod 18 is also pushed back and in turn "cocks" the hammer arrangement in the trigger mechanism 7. Upon subsequent forward movement of the foregrip 5, the cocking rod 18 is also moved forward leaving however the hammer cocked and ready for firing. The cylinder 2 is held in alignment position with the barrel 3 by the spring loaded pin 11. There may be an indent in the groove 10 receiving the pin 11 for holding the foregrip 5 in its foreward end position.

Figure 2C:
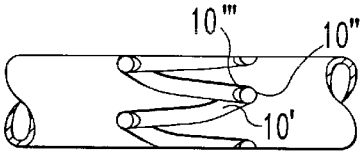

The invention is not limited to the embodiments as described in detail. For example the grooves may be in a different shape to provide a means for converting the linear back and forth movement into stepwise rotational movement of the cylinder 2. The groves may be arranged for example as shown in FIG. 2C, wherein a groove section 10' starts axially but curves toward the next groove section at the opposite axial end of the groove section 10'. In this case, the groove depth may be constant over the full length of the groove section 10'. An indent 10" may be provided at the jointure of two groove sections. The indent may have a reduced inclination area 10'" in the direction toward the next groove section to ease the movement of the pin 11 into the next groove section.

Figure 3:
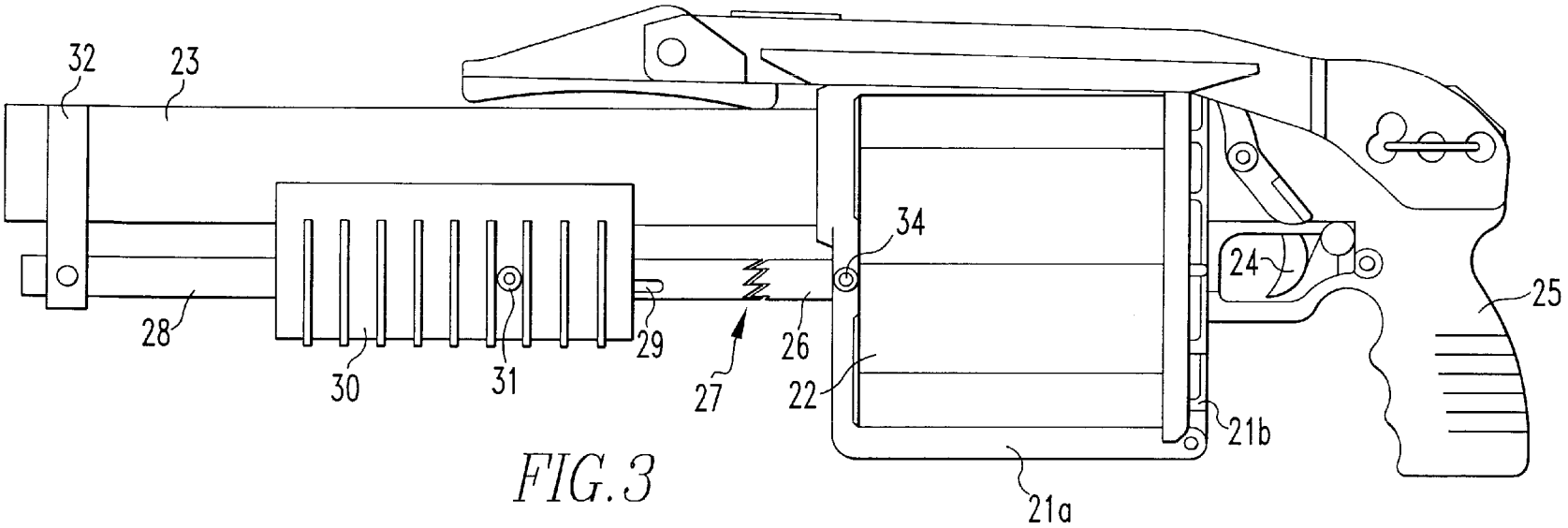
FIG. 3 shows another embodiment of the firearm according to the invention.

In another embodiment of the invention as shown in FIG. 3, wherein a revolver type gun is shown, which comprises a front frame part 21*a* and a rear frame part 21*b*, a cylinder 22 for holding cartridges is rotatably supported on the front frame part 21*a*. The chambers of the cylinder 22 can be designed for various sizes of cartridges and for holding various numbers of cartridges.

A barrel 23 is fixed to the front frame part 21*a*. A trigger mechanisms 24 is fitted into the rear frame part 21*b*. The rear frame part 21*b* is also provided with a stock 25 for holding the gun and operating the trigger mechanism.

For rotating the cylinder 22 to bring the various cylinder chambers holding the cartridges into alignment with the barrel, that is to move the cylinder from one chamber to the next, an indexing mechanism is provided. The indexing mechanism brings the cartridge chambers of the cylinder 22 into alignment with the barrel 23 and holds the cylinder 22 securely in such alignment position for the firing of the cartridge.

The indexing mechanism comprises a cylinder spindle 26, which is fixed to the cylinder 22 for rotation therewith and which includes a ratchet tooth mechanism 27 with a number of axially projecting teeth 27*b* (FIG. 4) machined into one end. The number of teeth 27*b* corresponds to the number of cylinder chambers that is to the number of cartridges the cylinder 22 can hold. An indexing spindle 28 is rotatably supported by a front support structure 32 supported below the barrel 23 in axial alignment with the cylinder spindle 26. The indexing spindle 28 is provided at its axial end adjacent the cylinder spindle 26 with axial teeth 27*a* corresponding to the teeth 27*b* in the cylinder spindle 26. The teeth 27*a* and 27*b* are held in engagement with each other so as to form the ratchet mechanism 27.

Figure 4:
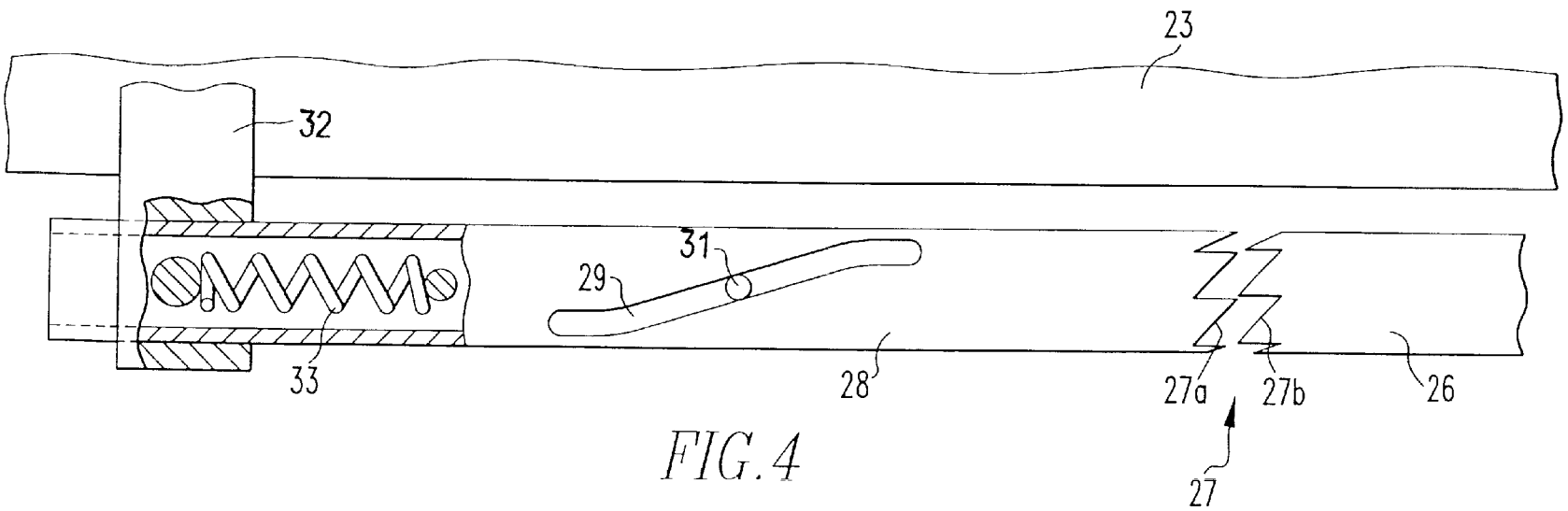
FIG. 4 shows, in detail, the indexing mechanism for the embodiment shown in FIG. 3, FIGS. 5*a* and 5*b* show embodiments with locking arrangements for locking the cartridge cylinder when one of its chambers is in axial alignment with the barrel of the firearm.

As shown in greater detail in FIG. 4, an angled slot 29 is machined into the indexing spindle 28. The angle and length of the slot is in direct relation to the number of cartridges the cylinder 22 can hold.

A foregrip 30 is longitudinally movably supported below the cylinder barrel 23. The foregrip 30 has a bore through which the indexing spindle 28 extends so that it is movable along the indexing spindle 28. Rotation of the foregrip 30 is prevented by engagement with the barrel 23. An actuation pin 31 is fitted into the foregrip 30 and extends into the angled slot 29. A compression spring 33 is provided in the front end of the indexing spindle 28 for biasing the indexing spindle 28 toward the cylinder spindle 26 for resiliently holding the teeth 27*a* and 27*b* of the ratchet mechanism 27 in engagement. A detent mechanism 34 is provided in the frame part 21*a* including a spring-loaded pin for retaining the cylinder 22 in each position in which one of its cartridge chambers is in alignment with the barrel 23.

Operation

To rotate the cylinder 22 from one cartridge chamber to the next the operator pushes, or pumps, the horizontal foregrip back and forth one time. When the foregrip 30 is pulled back, the spring-loaded indexing spindle 28 rotates and its teeth 27 "ride" over the respective teeth 27*b* of the then stationary cylinder spindle 26. The compression spring 33 pushes the indexing spindle 28 toward the cylinder spindle 26 for engagement of the teeth 27*a* with a new set of teeth 27*b*.

Upon pushing the foregrip 30 now forward the two spindles 28 and 26, which are now engaged with each other, rotate the cylinder to bring the next cylinder chamber into alignment with the barrel 33 that is into firing position. The cylinder 22 is held in firing position by holding the foregrip 30 in the forward position and also by the detent structure 34, which forms a cylinder stop. The spring-loaded detent structure 34 releases the cylinder 22 only when the foregrip 30 is forcefully pushed forward to rotate the cylinder spindle 28.

The pump action as described above shows the foregrip 5 or respectively 30 for each embodiment in the forward end position when the cylinder chamber is aligned with the barrel and in the firing position. However, it is also possible to make the arrangement so that the foregrip is in the rear end position when the cylinder cambers and the barrel are aligned for firing. This requires only that the slot sections in the rotatable tube 4 are arranged correspondingly. The cocking of the trigger mechanism may then be accomplished during forward movement of the foregrip 30. Some operators may prefer such an arrangement.

The invention is not limited to the arrangement shown in FIGS. 1–4. Instead of using a detent mechanism with a spring-loaded engagement pin 34 as indicated in FIG. 3, for example. A locking structure may be used, which firmly locks the cylinder 22 when a cartridge chamber 19 of the cylinder 22 is in alignment with the barrel 23.

Figure 5A:
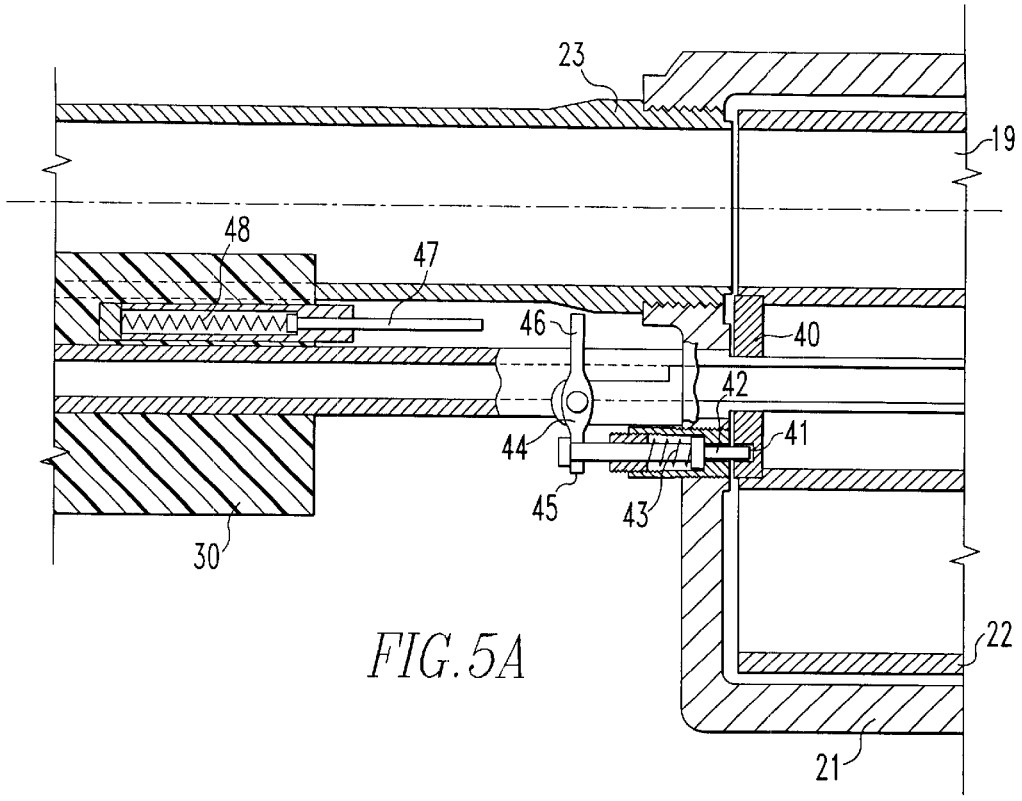
Figure 5B:
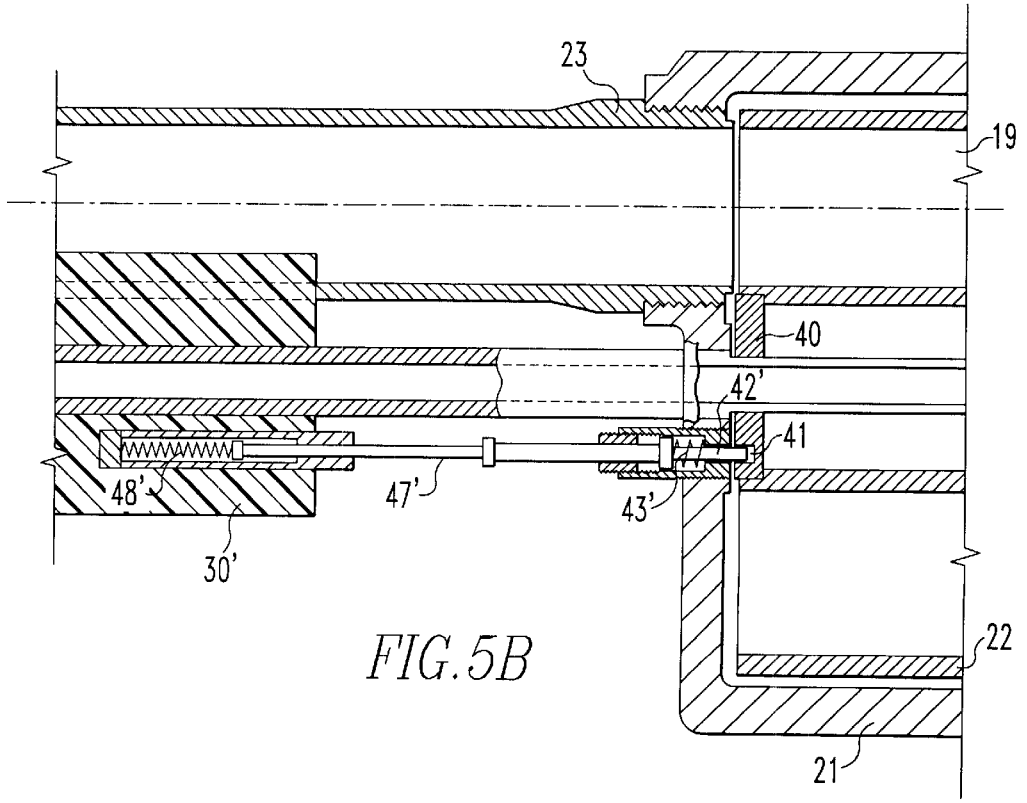

In such an arrangement as shown in FIGS. 5A and 5B, the cylinder includes an indexing plate 40 provided with indexing holes 41 arranged in one side of the indexing plate 40 in a circle in annularly spaced relationship. A locking pin 42 is slideably supported on the front frame part 21*a* and biased by a spring 43 toward the indexing plate 40 so that it enters an indexing hole 41 for locking the cylinder when a cartridge chamber 19 is in axial alignment with the barrel 23.

A double-armed lever 44 is pivotally mounted on the front part of the frame 21 with one arm 45 in engagement with the locking pin 42 and the other arm 46 being disposed in the path of movement of an operating rod 47, which is mounted on the foregrip 30. Preferably, the operating rod 47 is axially movably supported and is biased by a spring 48 toward the lever arm 46 for operating the lever 44.

In this arrangement, the cylinder chamber 19 is in alignment with the barrel 23 when the foregrip 30 is in its front end position. In this position, the spring-loaded locking pin 42 is fully inserted into the hole 41 in the cylinder indexing plate 40 so that the cylinder is locked in position.

When the foregrip 30 is moved backward, the spring-loaded operating pin 47 pushes the lever arm 46 of the lever 44 backwardly. The opposite arm 45 of the lever 44 lifts the locking pin 42 out of the hole 41 thereby releasing the cylinder 22. As a result, the cylinder 22 is free to rotate when the foregrip 30 is again pushed forward. When the foregrip 30 is moved forward, the lever arm 46 is disengaged and the locking pin is again spring-biased toward the indexing plate 40. When the foregrip reaches its front end position, the cylinder's next chamber 19 is in alignment with the barrel 23 and the next hole 41 is in alignment with the locking pin 42. The locking pin 42 enters the next hole 41 and locks the cylinder 22 in position.

The indexing plate 40 is preferably provided, ahead of the hole 41, with an angled groove, which guides and eases the pin into the hole 41. In this way, the surface area along which the pin 42 slides into the hole 41 is slightly recessed where it joins the hole 41 so that the opposite wall portion of the hole 41 forms a stop by which the pin 41 is engaged to stop the stepwise movement of the cylinder 22.

A slightly different arrangement may be provided for an arrangement in which the cylinder chambers are in alignment with the barrel when the foregrip is in the rear position as shown in FIG. 5B.

In this case, the locking pin 42' is spring-biased in the opposite direction so that it is normally disengaged from the hole 41. The operating pin 47' is arranged in axial alignment with the locking pin 42' so that it directly engages the locking pin when the foregrip 30' is moved to its rear end position. The locking pin 42' is moved into the hole 41 by the operating rod 47' against the force of the spring 43' of the locking pin 42' for locking the cylinder 22.

What is claimed is:

1. A revolving firearm having an indexing mechanism with a revolving cylinder and a pump action foregrip for advancing the revolving cylinder, said firearm including:

a front frame part and a rear frame part, a stock fitted on said rear frame part, a trigger mechanism mounted on said rear frame part, said revolving cylinder having chambers for holding cartridges and being rotatably supported on said front frame part, a barrel mounted on said front frame part, said pump action foregrip being supported on said front frame part so as to be axially slidable back and forth along said barrel, a spindle extending from said revolving cylinder into said foregrip, and an indexing mechanism for converting the back and forth movement of said foregrip into stepwise rotational movement of said cylinder for moving one of said cylinder chamber after the other in alignment with said barrel, said indexing means including cooperating slot and pin arrangements disposed in said spindle and said foregrip respectively, said pin extending into said slot for rotating said spindle when said foregrip is moved axially back and forth along said spindle.

2. A revolving firearm according to claim 1, wherein said spindle is provided with a number of angled grooves which are disposed circumferentially adjacent one another and extend at opposite angles and are joined at longitudinal ends thereof and said pin is mounted in said foregrip and extends into said grooves providing for a stepwise rotation of said spindle and, together therewith, of said cylinder upon back and forth movement of said foregrip.

3. A revolving firearm according to claim 2, wherein said pin is resiliently supported and said grooves are radially inclined with respect to the axis of said rotatable spindle such that the end of each groove is at a radially higher level then the beginning of the next groove whereby said spring loaded pin drops into the next groove when the end of the one groove is reached by axial movement of said foregrip.

4. A revolving firearm according to claim 2, wherein each groove section extends essentially axially at its beginning and curves toward the next groove section at the opposite axial end thereof.

5. A revolving firearm according to claim 2, wherein said spindle includes an axial bore and a cocking rod extends through said axial bore and is connected at one end to said foregrip and at its other end to a trigger mechanism for cocking the trigger mechanism by axial movement of said foregrip.

6. A revolving firearm according to claim 1, wherein said spindle includes a groove which is angled with respect to the longitudinal extension of said spindle and said fore-grip includes a pin extending into said angled groove so that said spindle rotates back and forth when said foregrip is moved axially back and forth and said spindle comprises two sections joined by a ratchet mechanism for converting the back and forth rotational movement of one section of said spindle into a stepwise rotation of the other section of said spindle, said other section being connected to said cylinder for the stepwise rotation of said cylinder.

7. A revolving firearm according to claim 6, wherein a detent structure is provided including a spring-loaded pin engaging said cylinder in angular positions of said cylinder in which a chamber of said cylinder is in alignment with said barrel.

8. A revolving firearm according to claim 1, wherein said cylinder includes an indexing plate with indexing holes arranged in a circle in annularly spaced relationship and a locking mechanism is provided which includes a locking pin received in one of said holes when one of said cylinder chambers is in alignment with said barrel for locking said cylinder in such alignment position.

9. A revolving firearm according to claim 8, wherein said locking mechanism includes a locking pin which is biased by a spring toward said indexing plate for entering one of said holes when in axial alignment with said locking pin for locking said cylinder and means are provided for removing said locking pin from said hole for releasing said cylinder when said foregrip is moved to its forward end position.

10. A revolving firearm according to claim 9, wherein said means for removing said locking pin from said hole includes a spring-loaded operating pin slideably mounted in said foregrip and a double arm pivot lever having one arm disposed in the path of movement of said operating pin and the other arm in engagement with said locking pin for moving said locking pin out of said hole when said one arm is engaged by said operating pin.

11. A revolving firearm according to claim 8, wherein said locking mechanism includes a locking pin which is biased by a spring away from said indexing plate for moving said locking pin out of said holes when said foregrip is in its forward end position and said foregrip includes engagement means biasing said pin toward said indexing plate and into a hole thereof when said foregrip is moved to its rearward end position for locking said cylinder when said foregrip is in its rearward end position.

12. A revolving firearm according to claim 11, wherein said engagement means includes a spring-loaded operating pin slideably mounted in said foregrip in axial alignment with said locking pin for biasing said locking pin toward said indexing plate and into a hole thereof for locking said cylinder when said foregrip is moved to its rearward end position.

* * * * *